US006781616B2

(12) United States Patent
Fisher

(10) Patent No.: US 6,781,616 B2
(45) Date of Patent: Aug. 24, 2004

(54) PREVENTING CREASE FORMATION IN DONOR WEB IN DYE TRANSFER PRINTER THAT CAN CAUSE LINE ARTIFACT ON PRINT

(75) Inventor: Terrence L. Fisher, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 8 days.

(21) Appl. No.: 10/242,241

(22) Filed: Sep. 12, 2002

(65) Prior Publication Data

US 2004/0051774 A1 Mar. 18, 2004

(51) Int. Cl.[7] ..... B41J 2/335
(52) U.S. Cl. ..... 347/217
(58) Field of Search ..... 400/225, 241, 400/234, 240, 237, 240.4; 347/217, 215, 218, 219

(56) References Cited

U.S. PATENT DOCUMENTS 6,292,207 B1 * 9/2001 Sogabe ..... 347/217
6,307,583 B1 * 10/2001 Randolph et al. ..... 347/217
6,315,471 B1 * 11/2001 Hsieh et al. ..... 400/234
6,494,629 B2 * 12/2002 Hayashi et al. ..... 400/120.14
2001/0046401 A1 * 11/2001 Lien et al. ..... 400/240
2002/0041782 A1 * 4/2002 Mastinick et al. ..... 400/192
2003/0123915 A1 * 7/2003 Klinefelter et al. ..... 400/237

* cited by examiner

*Primary Examiner*—K. Feggins
(74) *Attorney, Agent, or Firm*—Roger A. Fields; Mark G. Bocchetti

(57) ABSTRACT

A method of equalizing web-stretching caused by web tensioning in a dye transfer printer that is for use with a donor web having a dye transfer area and opposite edge areas alongside the dye transfer area, includes the steps of heating a dye transfer area to effect a dye transfer from the dye transfer area to a dye receiver, and heating the edge areas alongside the dye transfer area less than the dye transfer area is heated to effect the dye transfer, but sufficiently so that the edge areas may be stretched by tension substantially the same as the dye transfer area may be stretched. If the edge areas alongside a dye transfer area being used in the printer are stretched substantially the same as the dye transfer area, the likelihood of any creases being created in the next unused transfer area is substantially reduced. Thus, no line artifacts will be printed on a dye receiver in the printer.

9 Claims, 10 Drawing Sheets

1

PREVENTING CREASE FORMATION IN DONOR WEB IN DYE TRANSFER PRINTER THAT CAN CAUSE LINE ARTIFACT ON PRINT

CROSS REFERENCE TO RELATED APPLICATIONS CROSS REFERENCE TO RELATED APPLICATIONS

Reference is made to commonly assigned co-pending applications Ser. No. 10/242,210 entitled PREVENTING CREASE FORMATION IN DONOR WEB IN DYE TRANSFER PRINTER THAT CAN CAUSE LINE ARTIFACT ON PRINT, filed concurrently herewith in the name of Terrence L. Fisher; Ser. No. 10/242,262 entitled PREVENTING CREASE FORMATION IN DONOR WEB IN DYE TRANSFER PRINTER THAT CAN CAUSE LINE ARTIFACT ON PRINT, filed concurrently herewith in the names of Terrence L. Fisher and Richard Salter; Ser. No. 10/242,263 entitled PREVENTING CREASE FORMATION IN DONOR WEB IN DYE TRANSFER PRINTER THAT CAN CAUSE LINE ARTIFACT ON PRINT, filed concurrently herewith in the name of Terrence L. Fisher; and Ser. No. 10/242,248 entitled PREVENTING CREASE FORMATION IN DONOR WEB IN DYE TRANSFER PRINTER THAT CAN CAUSE LINE ARTIFACT ON PRINT, filed concurrently herewith in the name of Terrence L. Fisher.

FIELD OF THE INVENTION

The invention relates generally to dye transfer printers such as thermal printers, and in particular to the problem of crease formation in successive dye transfer areas of the donor web. Crease formation in the dye transfer area can result in an undesirable line artifact being printed on a dye receiver.

BACKGROUND OF THE INVENTION

A typical multi-color donor web that is used in a thermal printer is substantially thin and has a repeating series of three different color sections or patches such as a yellow color section, a magenta color section and a cyan color section. Also, there may be a transparent laminating section after the cyan color section.

Each color section of the donor web consists of a dye transfer area that is used for dye transfer printing and pair of longitudinal edge areas alongside the transfer area which are not used for printing. The dye transfer area is about 95% of the web width and the two edge areas are each about 2.5% of the web width.

To make a print, the various color dyes in the dye transfer areas of a single series of yellow, magenta and cyan color sections on a donor web are successively heat-transferred by a print head onto a dye receiver such as paper or transparency sheet or roll. The dye transfer from each transfer area to the dye receiver is done line-by-line widthwise across the transfer area via a bead of selectively heated resistive elements on the print head. The print head makes line contact across the entire width of the color section, but it only heats the dye transfer area, i.e. it does not heat the two edge areas alongside the dye transfer area.

As each color section is used for dye transfer at the print head, the donor web is subjected to a longitudinal tension between a donor supply spool and a donor take-up spool which are rearward and forward of the print head. The longitudinal tension, coupled with the heat from the print head, causes a used color section to be stretched lengthwise at least from the print head to the donor take-up spool. Since the dye transfer area in a used color section has been heated by the print head, but the two edge areas alongside the transfer area have not been heated, the transfer area tends to be stretched more than the edge areas. As a result, the transfer area becomes thinner than the two edge areas and develops a wave-like or ripple distortion widthwise between the edge areas.

After the last line is transferred from a dye transfer area to a dye receiver, and as the used color section is advanced forward from the print head and onto the donor take-up spool, the wave-like or ripple distortion in the transfer area causes one or more creases to form at least in a short trailing or rear end portion of the transfer area that has not been used for dye transfer. The creases tend to spread rearward from the trailing or rear end portion of the used transfer area into a leading or front end portion of an unused transfer area in the next (fresh) color section being advanced to the print head. The creases appear to be created because of the difference in thickness between the used transfer area and the edge areas as they are wound under tension from the print head and onto the donor take-up spool.

When a used color section is wrapped under tension around the donor take-up spool, the edge areas wrap differently on the spool than does the used transfer area because of the difference in thickness between the transfer area and the edge areas. As each additional color section is wrapped around the donor take-up spool, the convolution build-up of the thicker edge areas on the spool becomes significantly greater than the convolution build-up of the thinner transfer areas. This non-uniform winding of the used color section increases the likelihood of one or more creases being created because the convolution build-up of the thicker edge areas on the donor take-up spool adds to the tension and distortion of the used transfer areas.

A problem that can result is that a crease in the leading or front end portion of the unused transfer area of the next (fresh) color section will cause an undesirable line artifact to be printed on a leading or front end portion of the dye receiver when the print head is applied to the crease. The line artifact printed on the receiver is about 0.5 inches in length.

The question presented therefore is how to solve the problem of the creases being created in the unused transfer area of each fresh color section so that no line artifacts are printed on the dye receiver.

SUMMARY OF THE INVENTION

According to one aspect of the invention, a method of equalizing web-stretching caused by web tensioning in a dye transfer printer that is for use with a donor web having a dye transfer area and opposite edge areas alongside the dye transfer area, comprises:

heating a dye transfer area to effect a dye transfer from the dye transfer area to a dye receiver; and heating the edge areas alongside the dye transfer area less than the dye transfer area is heated to effect the dye transfer, but heating the edge areas sufficiently so that they may be stretched by tension substantially the same as the dye transfer area may be stretched, whereby the dye transfer area will not be stretched thinner than the edge areas.

According to another aspect of the invention, a dye transfer printer in which a donor web having a dye transfer area and opposite edge areas alongside the dye transfer area may be stretched by tension, comprises:

means for heating a dye transfer area to effect a dye transfer from the dye transfer area to a dye receiver; and means for heating the edge areas alongside the dye transfer area less than the dye transfer area is heated to effect the dye transfer, but heating the edge areas sufficiently so that they may be stretched by tension substantially the same as the dye transfer area may be stretched, whereby the dye transfer area will not be stretched thinner than the edge areas.

If the edge areas alongside a dye transfer area being used for dye transfer in the printer are stretched substantially the same as the dye transfer area, the dye transfer area will not be stretched thinner than the edge areas and the likelihood of a wave-like or ripple distortion developing across the dye transfer area will be substantially reduced. As a result, there should not be any creases formed in the next unused transfer area which can cause line artifacts to be printed on a dye receiver in the printer.

DETAILED DESCRIPTION OF THE INVENTION

Donor Web

Figure 1:
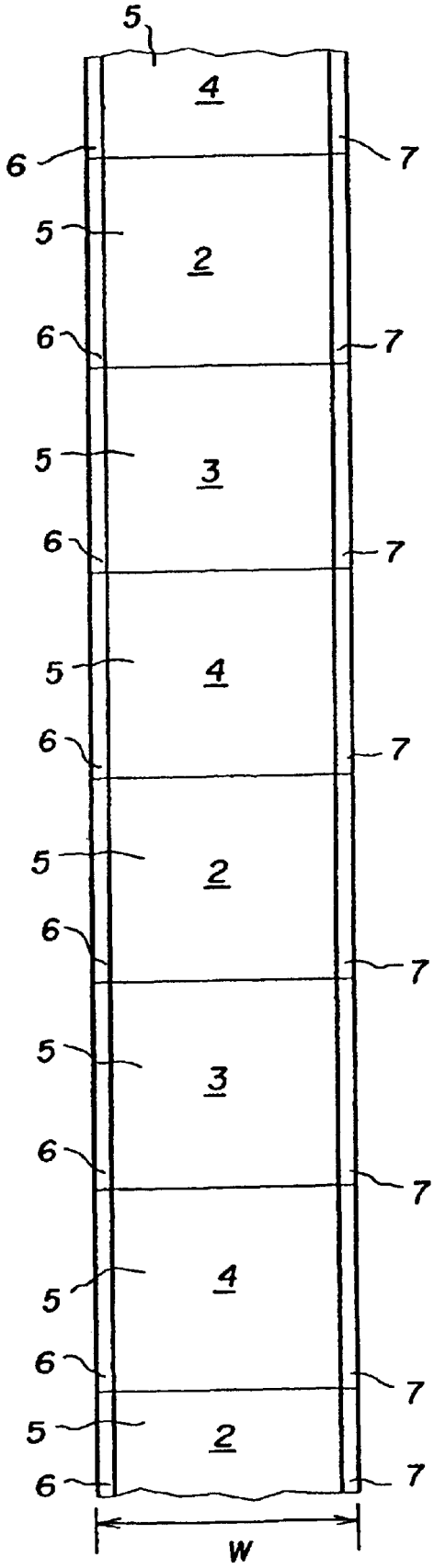
FIG. 1 is plan view of a typical donor web including successive dye transfer areas and opposite edge areas alongside each one of the dye transfer areas.

FIG. 1 depicts a typical multi-color donor web or ribbon 1 that is used in a thermal color-printer. The donor web 1 is substantially thin and has a repeating series (only two shown) of three different color sections or patches such as a yellow color section 2, a magenta color section 3 and a cyan color section 4. Also, there may be a transparent laminating section (not shown) after the cyan color section 4.

Each one of the successive color sections 2–4 of the donor web 1 consists of a dye transfer area 5 that is used for dye transfer printing and pair of longitudinal edge areas 6 and 7 alongside the transfer area which are not used for printing. The dye transfer area 5 is about 95% of the web width W and the two edge areas 6 and 7 are each about 2.5% of the web width.

Dye Transfer Printer

FIGS. 2–6 depict operation of a known prior art thermal color-printer 10.

Figure 2:
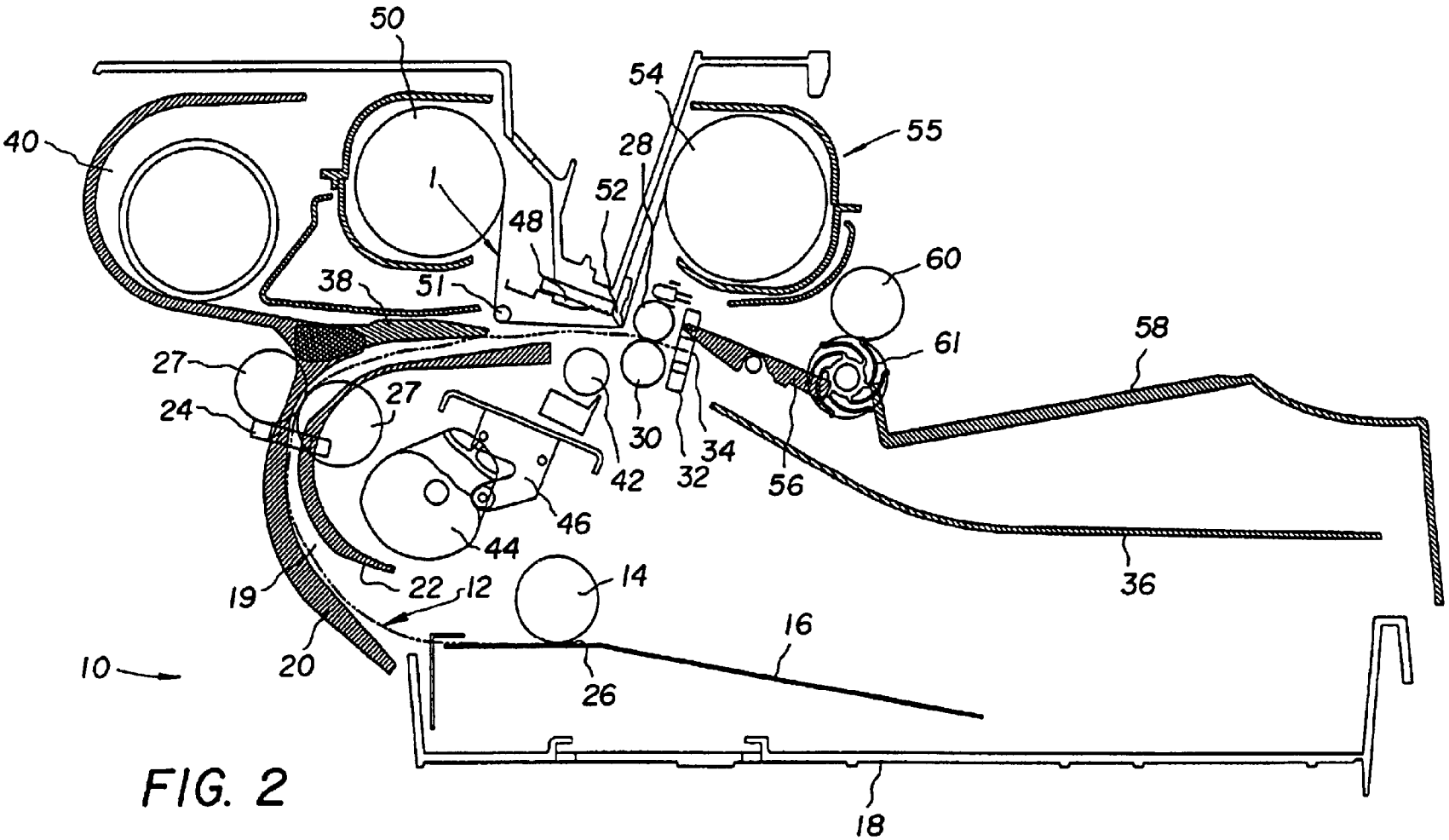
FIG. 2 is an elevation section view, partly in section, of a dye transfer printer, showing a beginning cycle during a printer operation.

Beginning with FIG. 2, a dye receiver sheet 12, e.g. paper or transparency, is initially advanced forward via coaxial pick rollers 14 (only one shown) off a floating platen 16 in a tray 18 and into a channel 19 defined by a pair of curved longitudinal guides 20 and 22. When a trailing (rear) edge sensor 24 midway in the channel 19 senses a trailing or rear edge 26 of the receiver sheet 12, it activates at least one of pair of parallel axis urge rollers 27, 27 in the channel 19. The activated rollers 27, 27 advance the receiver sheet 12 forward through the nip of a capstan roller 28 and a pinch roller 30, positioned beyond the channel 19, and to a leading (front) edge sensor 32.

Figure 3:
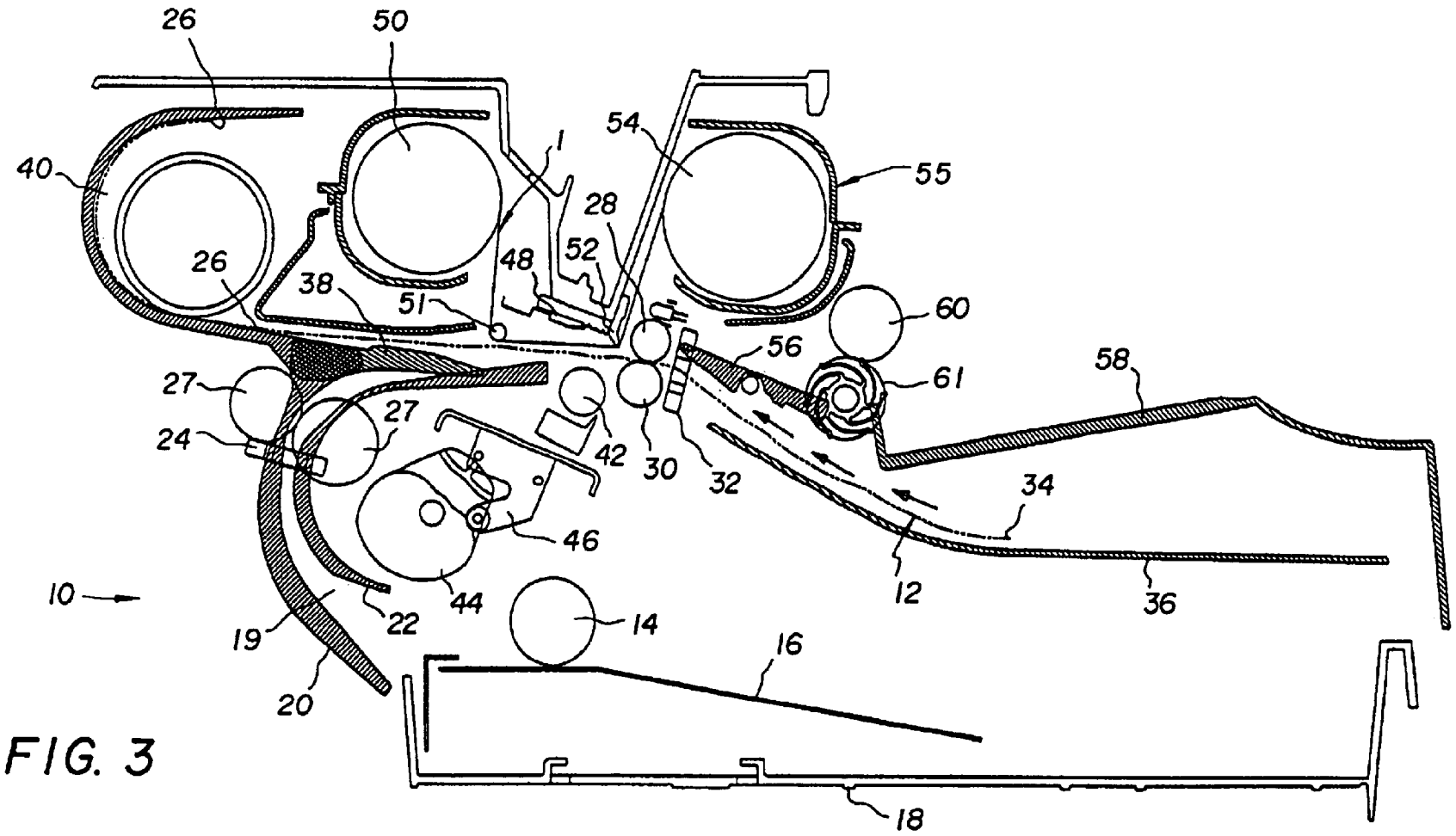
FIGS. 3 and 4 are elevation section views of the dye transfer printer as in FIG. 2, showing other cycles during the printer operation.

In FIG. 3, the leading edge sensor 32 has sensed a leading or front edge 34 of the dye receiver sheet 12 and activated the capstan roller 28 to cause that roller and the pinch roller 30 to advance the receiver sheet forward onto an intermediate tray 36. The receiver sheet 12 is advanced forward into the intermediate tray 36 so that the trailing or rear edge 26 of the receiver sheet can be moved beyond a hinged exit door 38 which is a longitudinal extension of the curved guide 20. Then, as illustrated, the hinged exit door 38 closes and the capstan and pinch rollers 28 and 30 are reversed to advance the receiver sheet 12 rearward, i.e. rear edge 26 first, partially into a rewind chamber 40.

To make a print, the various color dyes in the dye transfer areas 5 of a single series of the color sections 2, 3 and 4 on the donor web 1 must be successively heat-transferred onto the dye receiver sheet 12. This is shown in FIGS. 4 and 5.

Figure 4:
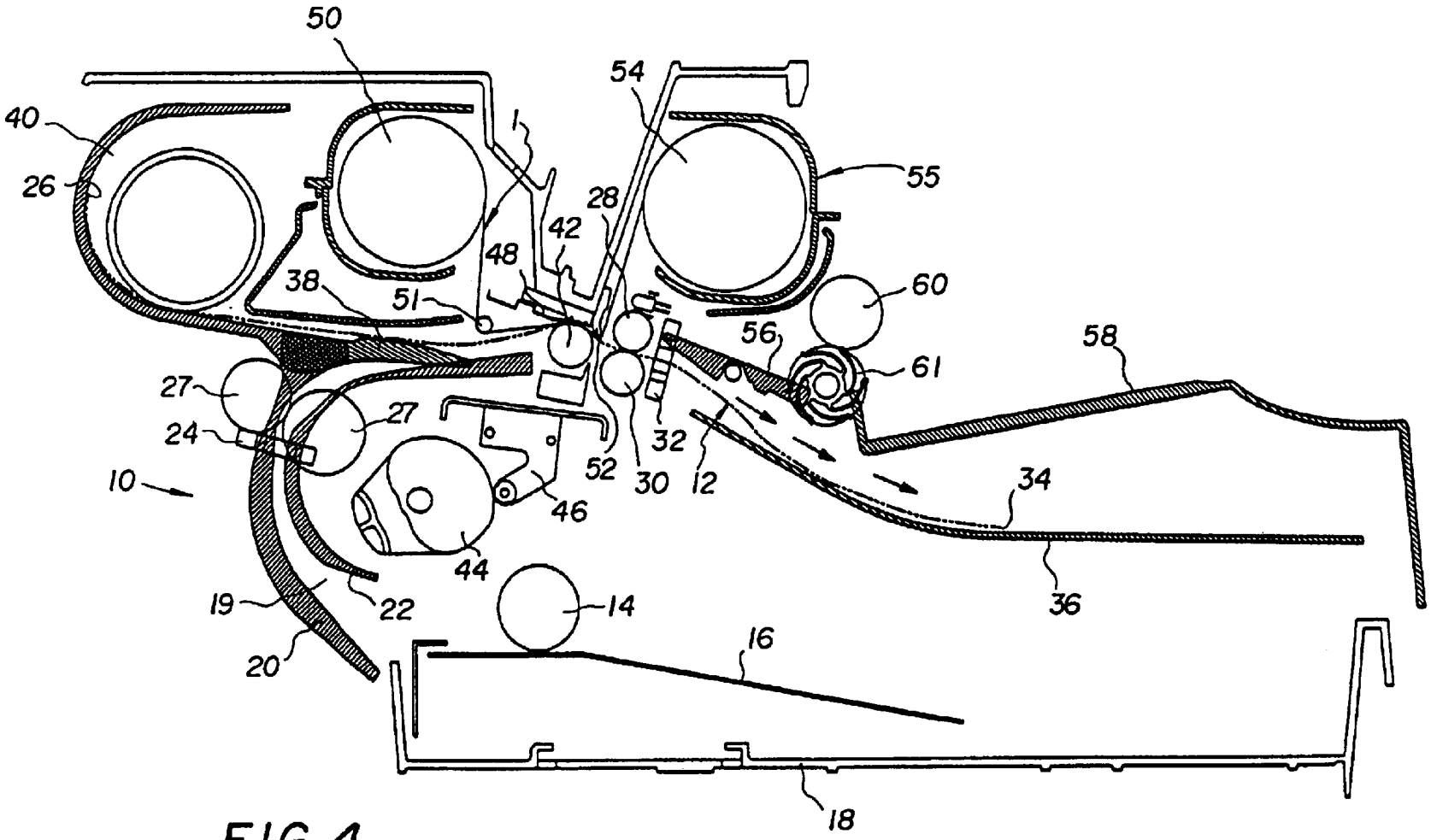

In FIG. 4, a platen roller 42 is shifted via a rotated cam 44 and a platen lift 46 to adjacent a thermal print head 48. This causes the dye receiver sheet 12 and a first one of the successive color sections 2, 3, and 4 of the donor web 1 to be locally held together between the platen roller 42 and the print head 48. The capstan and pinch rollers 28 and 30 are reversed to again advance the dye receiver sheet 12 forward to begin to return the receiver sheet to the intermediate tray 36. At the same time, the donor web 1 is advanced forward under a longitudinal tension, from a donor supply spool 50, over a first stationary (fixed) web guide 51, the print head 48 and a second stationary (fixed) web guide or guide nose 52, and then onto a donor take-up spool 54. The donor supply and take-up spools 50 and 54 together with the donor web 1 are provided in a replaceable cartridge 55 that is loaded into the printer 10.

When the first one of the successive color sections 2, 3 and 4 of the donor web 1 is moved forward in intimate contact with the print head 48 in FIG. 4, the color dye in the dye transfer area 5 of that color section is heat-transferred onto the dye receiver sheet 12. The dye transfer from the transfer area 5 to the receiver sheet 12 is done line-by-line (i.e. row-by-row) widthwise across the transfer area via a bead of selectively heated resistive elements (shown in the preferred embodiment of the invention in FIG. 11 as 47A and 47B) on the print head 48. The print head 48 makes line contact across the entire width W of the first color section 2 as depicted in FIG. 5 (the guide nose 52 and the dye receiver sheet 12 are not shown). However, the print head 48 only heats the dye transfer area 5, i.e. it does not heat two edge areas 6 and 7 alongside the transfer area.

Figure 5:
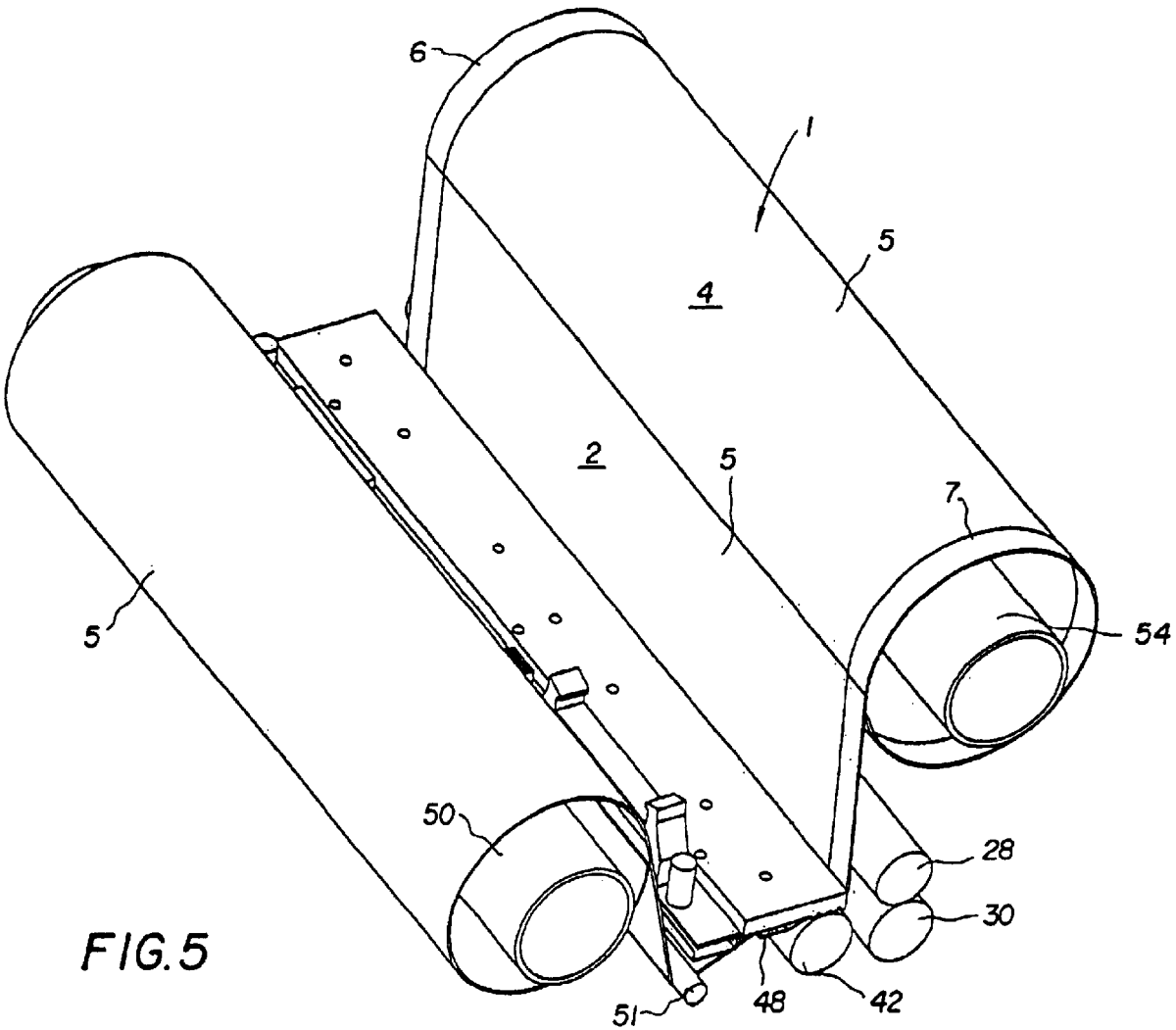
FIG. 5 is perspective view of a printing or dye transfer station in the dye transfer printer.

As the first color section 2 is used for dye transfer line-by-line, it moves from the print head 48 and over the guide nose 52 in FIGS. 4 and 5. Then, once the dye transfer for the first color section 2 is completed, the platen roller 42 is shifted via the rotated cam 44 and the platen lift 46 from adjacent the print head 48 to separate the platen roller from the print head. This is shown in FIG. 3.

Then, the capstan and pinch rollers 28 and 30 are reversed to advance the dye receiver sheet 12 rearward, i.e. trailing or rear edge 26 first, partially into the rewind chamber 40 and the used color section 2 is wrapped about the donor take-up spool 54. See FIG. 3.

Then, the cycle in FIG. 4 is repeated with the next (fresh) one of the successive color sections 2, 3 and 4.

Once the last one of the successive color sections 2, 3 and 4 is used, the dye transfer to the dye receiver sheet 12 is completed. Then, in FIG. 3, the platen roller 42 is shifted via the rotated cam 44 and the platen lift 46 from adjacent the print head 48 to separate the platen roller from the print head, the capstan and pinch rollers 28 and 30 are reversed to advance the receiver sheet 12 rearward, i.e. trailing or rear edge 26 first, partially into the rewind chamber 40, and the last color section 4 is wrapped about the donor take-up spool 54.

Figure 6:
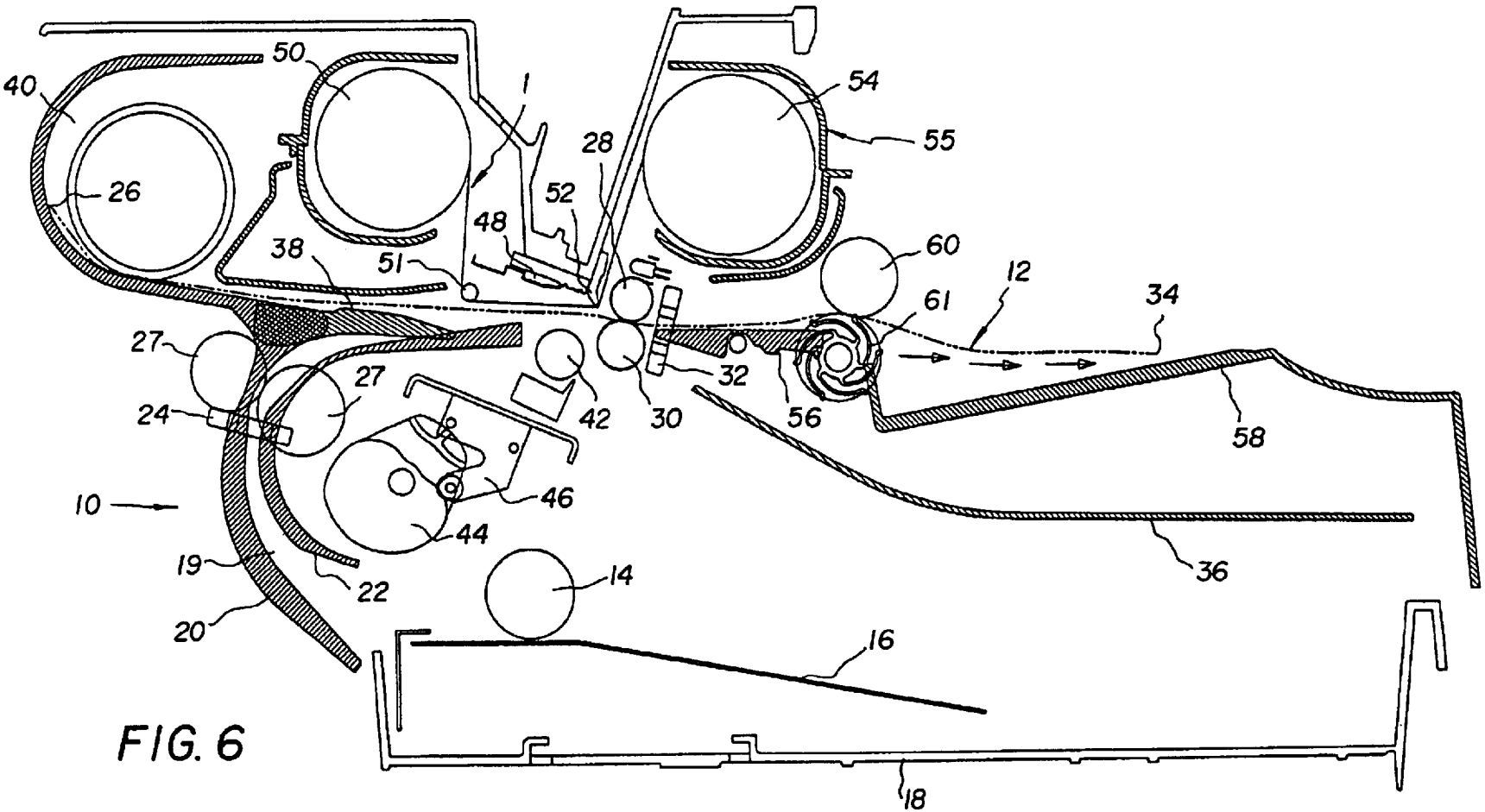
FIG. 6 is an elevation section view of the dye transfer printer as in FIG. 2, showing a final cycle during the printer operation.

Finally, as shown in FIG. 6, the platen roller 42 remains separated from the print head 48 and the capstan and pinch rollers 28 and 30 are reversed to again advance the dye receiver sheet 12 forward. However, in this instance a diverter 56 is pivoted to divert the receiver sheet 12 to an exit tray 58 instead of returning the receiver sheet to the intermediate tray 36 as in FIG. 4. A pair of parallel axis exit rollers 60 and 62 aid in advancing the receiver sheet 12 into the exit tray 58.

Prior Art Problem

Figure 7:
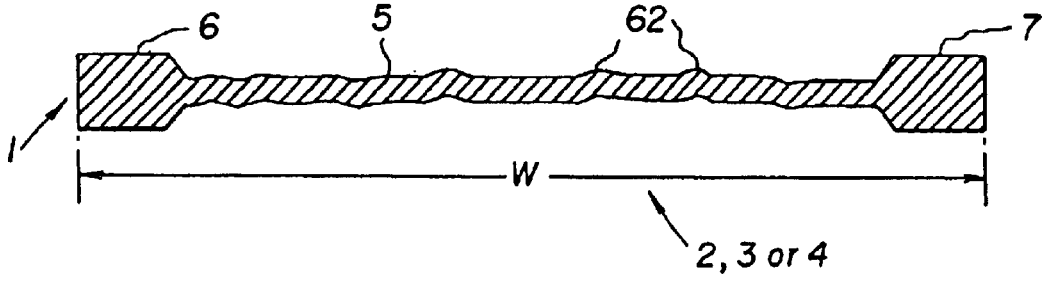
FIG. 7 is a cross section view of the donor web when a dye transfer area has been stretched thinner than the two edge areas alongside the dye transfer area, showing a wave-like or ripple distortion widthwise between the edge areas.

As each one in a single series of the color sections 2, 3 and 4 of the donor web 1 is successively used for dye transfer at the print head 48 in FIGS. 4 and 5, it is stretched lengthwise under tension, particularly over the second stationary (fixed) web guide or guide nose 52. Since the dye transfer area 5 in a used color section 2, 3 or 4 has been heated by the print head 48, but the two edge areas 6 and 7 alongside the transfer area have not been heated, the transfer area tends to be stretched under tension more than the edge areas. As a result, the dye transfer area 5 becomes thinner than the two edge areas and develops a wave-like or ripple distortion 62 widthwise between the edge areas. This is shown in FIG. 7.

Figure 8:
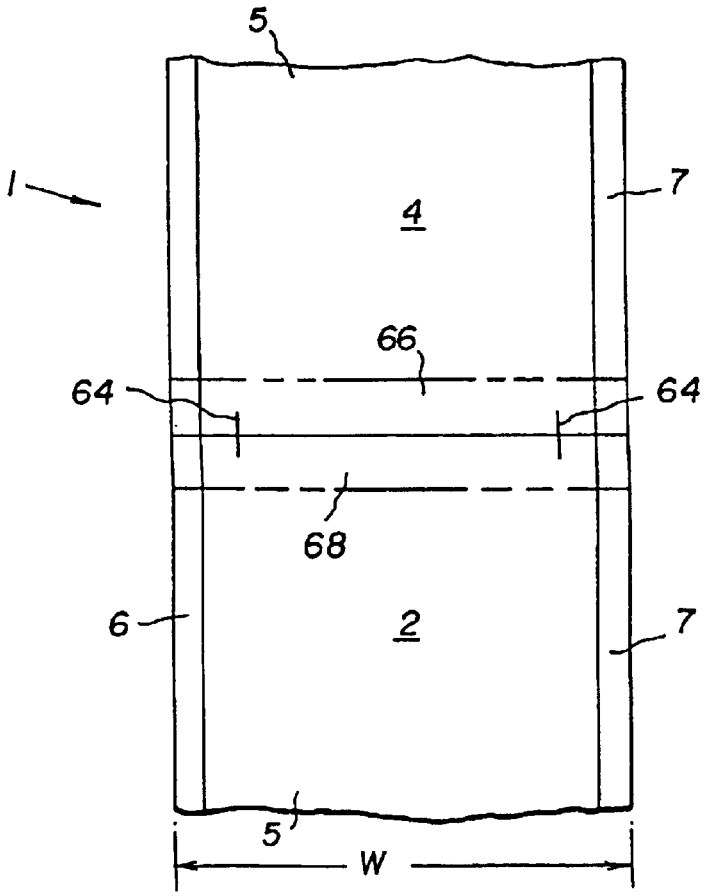
FIG. 8 is a plan view of the donor web, showing creases spreading rearward from a trailing or rear end portion of a used transfer area into a leading or front end portion of an unused transfer area in the next (fresh) color section.

After the last line is transferred from a dye transfer area 5 to the dye receiver sheet 12, and as the used color section 2, 3 or 4 is advanced forward from the print head 48, over the guide nose 52, and onto the donor take-up spool 54, the wave-like or ripple distortion 62 in the transfer area causes one or more creases 64 to be formed at least in a short trailing or rear end portion 66 of the transfer area that has not been used for dye transfer. See FIG. 8. The creases 64 tend to spread rearward from the trailing or rear end portion 66 of the used transfer area 5 into a leading or front end portion 68 of an unused transfer area 5 in the next (fresh) color section 2, 3 or 4 being advanced to the print head 48. The creases 64 appear to be created because of the difference in thickness between the used transfer area 5 and the edge areas 6 and 7 as they are wound under tension from the print head 48, over the guide nose 42, and onto the donor take-up spool 54.

Figure 9:
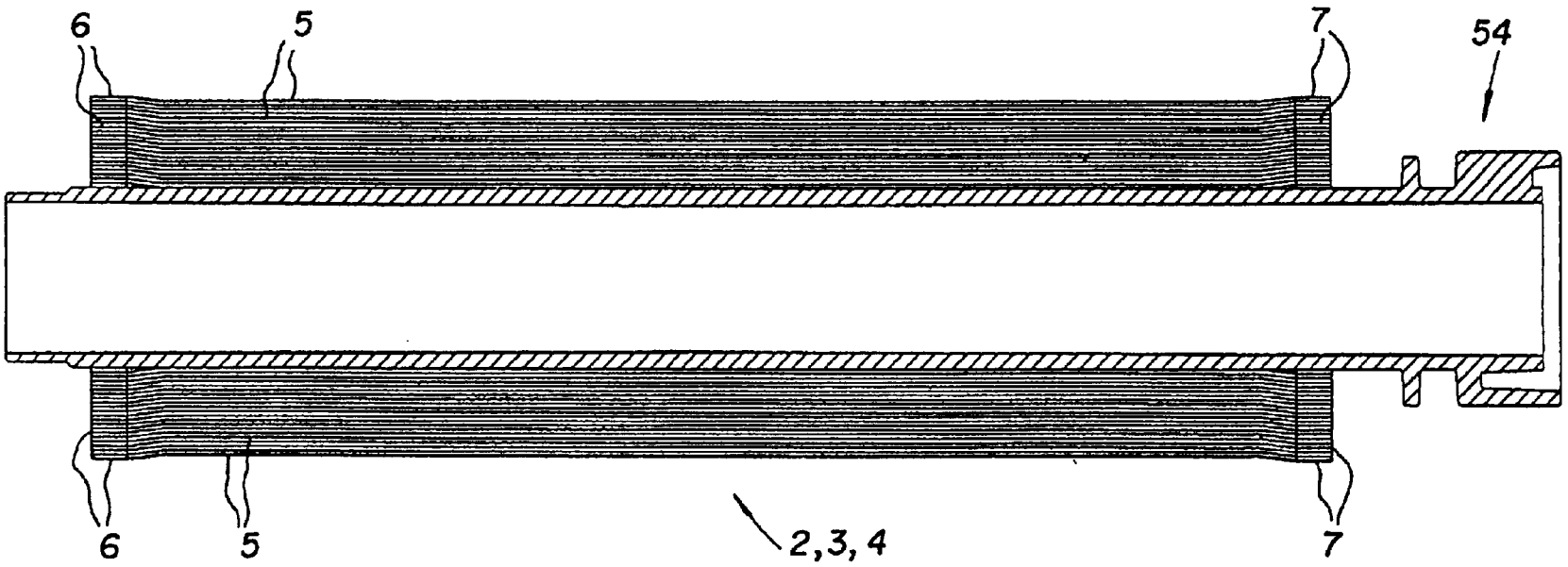
FIG. 9 is a cross-section view of a donor take-up spool in the dye transfer printer.

When a used color section 2, 3 or 4 is wrapped under tension around the donor take-up spool 54, the two edge areas 6 and 7 wrap differently on the spool than does the used transfer area 5 because of the difference in thickness between the transfer area and the edge areas. See FIGS. 7 and 9. As each additional color section 2, 3 or 4 is wrapped around the donor take-up spool 54, the convolution build-up of the thicker edge areas 6 and 7 on the spool becomes significantly greater than the convolution build-up of the thinner transfer areas 5. See FIG. 9. This non-uniform winding of the used color section increases the likelihood of one or more of the creases 64, shown in FIG. 8, being created because the convolution build-up of the thicker edge areas 6 and 7 on the donor take-up spool 54 adds to the tension and distortion of the used transfer areas 5.

Figure 10:
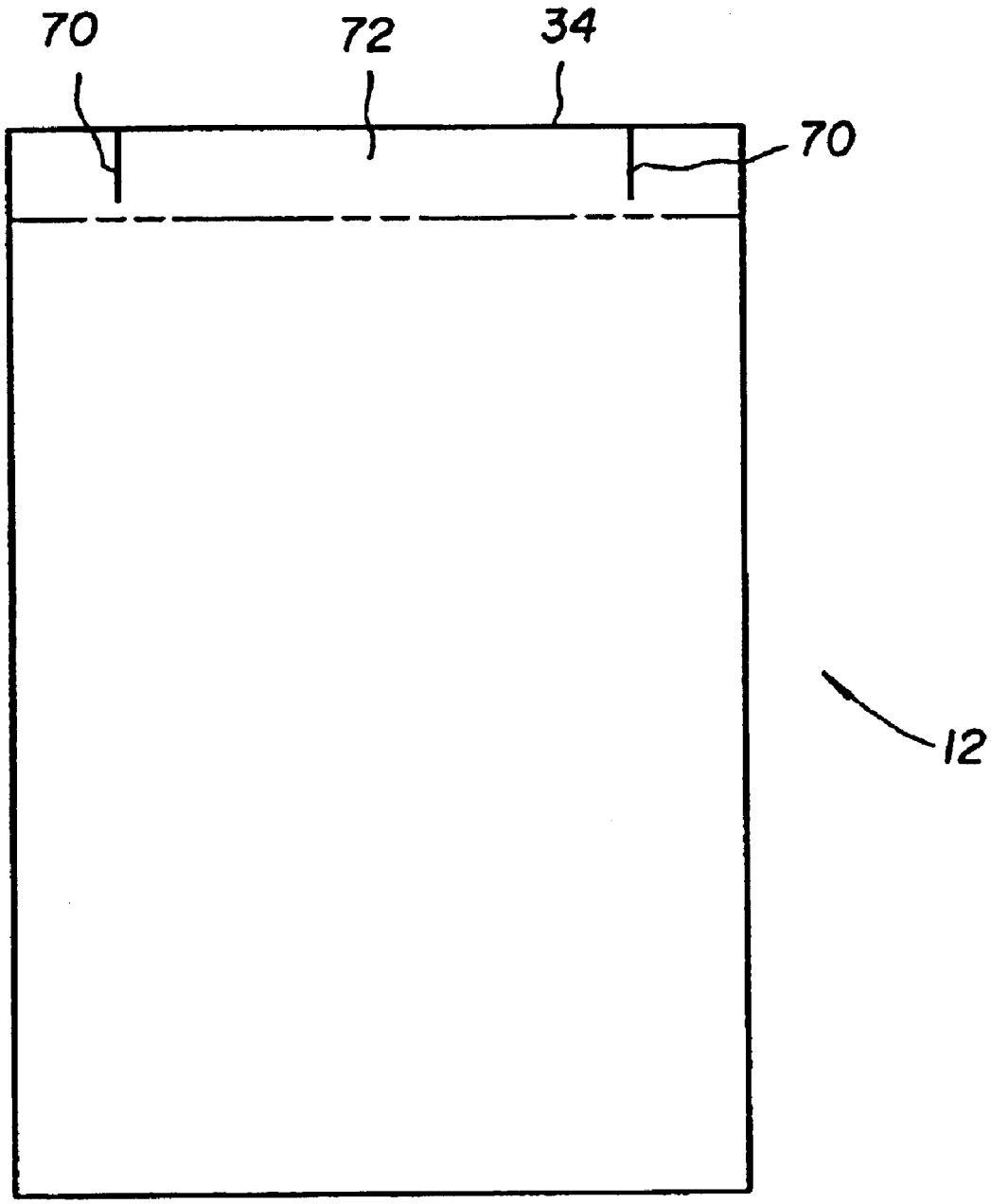
FIG. 10 is a plan view of a dye receiver sheet, showing line artifacts printed on a leading or front edge portion of the dye receiver sheet.

A problem that can result is that a crease 64 in the leading or front end portion 68 of the unused transfer area 5 of the next (fresh) color section 2, 3 or 4 will cause an undesirable line artifact 70 to be printed on a leading or front end portion 72 of the dye receiver sheet 12 when the print head 48 is applied to the crease. See FIG. 10. The line artifact 70 printed on the dye receiver sheet 12 is about 0.5 inches in length.

The question presented therefore is how to solve the problem of the creases 64 being created in the unused transfer area 5 of each fresh color section 2, 3 or 4 so that no line artifacts 70 are printed on the dye receiver sheet 12.

Solution

It has been determined that the likelihood of the wave-like or ripple distortion 62 developing across the donor web 1 in the dye transfer printer 10 (as shown in FIG. 7) when the donor web 1 is advanced under tension from the donor supply spool 50, over the first fixed web guide 51. The print head 48 and the second fixed web guide or guide nose 52, and onto the donor take-up spool 54 can be significantly reduced. This can be done by heating the edge areas 6 and 7 alongside a dye transfer area 5 less than the dye transfer area is heated to effect the dye transfer to the dye receiver sheet 12, but heating the edge areas sufficiently so that they may be stretched by tension substantially the same as the dye transfer area may be stretched.

If the edge areas 6 and 7 alongside a dye transfer area 5 are stretched substantially the same as the dye transfer area, the dye transfer area will not be stretched thinner than the edge areas as in FIG. 7, and the likelihood of the wave-like or ripple distortion 62 developing across the dye transfer area as in that FIG. will be substantially reduced. Consequently, there should not be any creases 64 formed in the next unused (fresh) transfer area as in FIG. 8 which can cause line artifacts 10 to be printed on the dye receiver sheet 12 as in FIG. 10.

Figure 11:
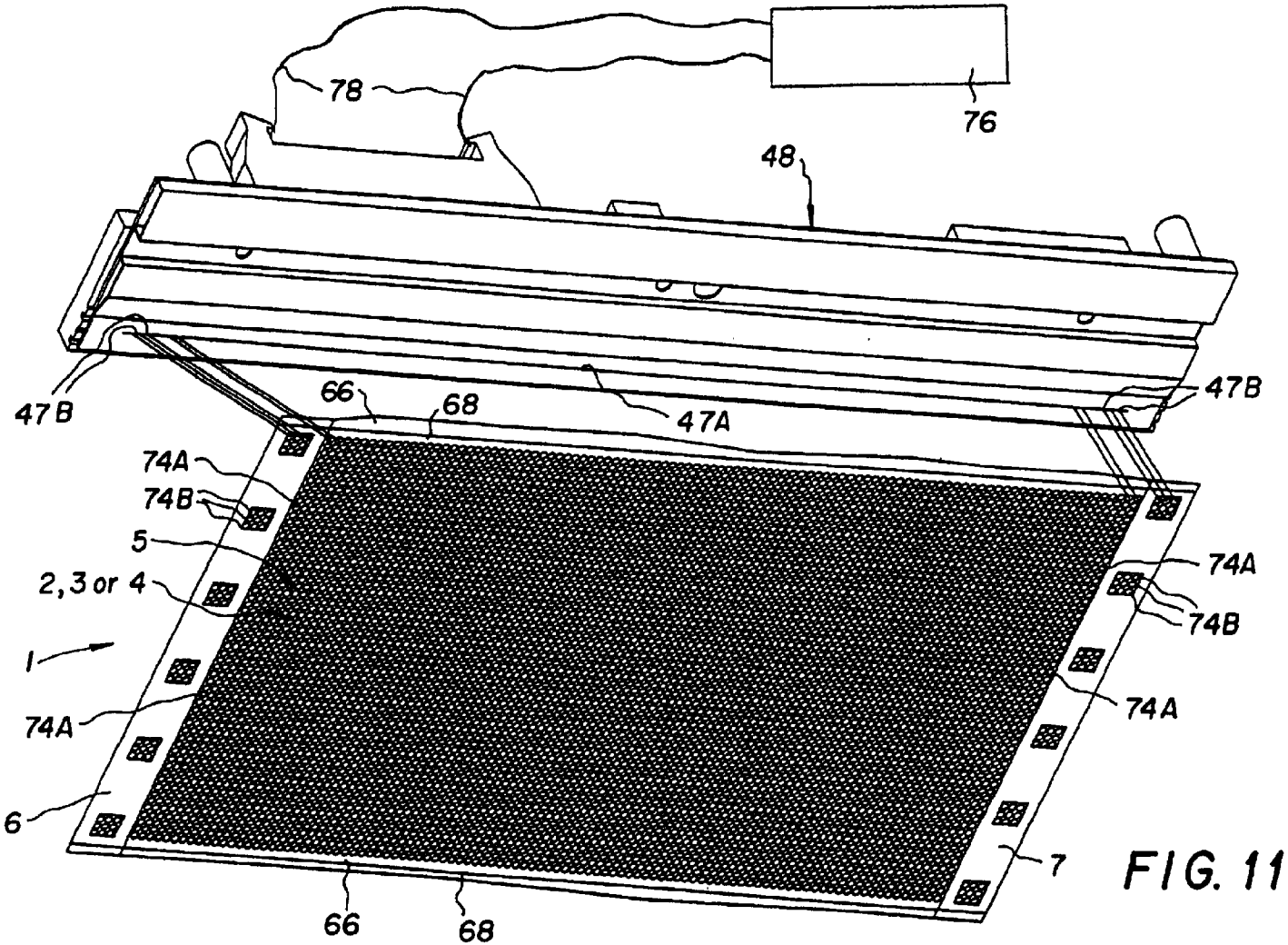
FIG. 11 is a perspective view of print head at the printing or dye transfer station in FIG. 2, showing a bead of selectively heated resistive elements in the print head for heating the dye transfer area to effect a dye transfer from the dye transfer area to the dye receiver sheet and for heating the two edge areas alongside the dye transfer area less frequently than the dye transfer area is heated, but sufficiently so that the two edge areas may be stretched substantially the same as the dye transfer area may be stretched, according to a preferred embodiment of the invention.

FIG. 11 depicts a method of equalizing web stretching in the dye transfer printer 10 according to a preferred embodiment of the invention. According to the method, those resistive elements 47A that make line contact with a dye transfer area 5 line-by-line to effect the dye transfer are selectively heated. By contrast, those resistive elements 47B that make line contact with the edge areas 6 alongside a dye transfer area 5 are heated less frequently than line-by-line. However, they are heated with sufficient frequency so that the edge areas 6 and 7 may be stretched by tension substantially the same as the dye transfer area 5 may be stretched, in order that the dye transfer area will not be stretched thinner than the edge areas.

The print head 48 has a bead of 2,580 resistive elements 47A and 47B, each having a width of 0.0035 inches, and as shown in FIG. 11 they are arranged in a single straight line (i.e. row) to make contact line-by-line across a dye transfer area 5 and the edge areas 6 and 7 alongside the dye transfer area when the donor web 1 is advanced under tension over the bead of resistive elements. In one example, the resistive elements 47A that make line contact with a dye transfer area 5 are selectively heated for two-hundred successive lines (i.e. rows) indicated as the lines (i.e. rows) 74A in FIG. 11. Then, the resistive elements 47B that make line contact with the edge areas 6 and 7 alongside a dye transfer area 5 are heated for ten successive lines (i.e. rows) 74B at the same time that the resistive elements are selectively heated for the same number of lines 74A. That is, the resistive elements 47B are heated simultaneously with the resistive elements 47A for 10 successive lines (i.e. rows). Then, only the resistive elements 47A are selectively heated for two-hundred successive lines (i.e. rows) 74A. This cycle of heating the resistive elements 47A for two-hundred lines 74A and heating both the resistive elements 47A and 47B for ten lines 47A and 47B is repeated along the dye transfer area 5 and the edge areas 6 and 7 as indicated in FIG. 11.

In another example, the resistive elements 47A that make line contact with a dye transfer area 5 are selectively heated for four-hundred successive lines (i.e. rows) 74A. Then, the resistive elements 47B that make line contact with the edge areas 6 and 7 alongside a dye transfer area 5 are heated for twenty successive lines (i.e. rows) 74B at the same time that the resistive elements are selectively heated for the same number of lines 74A. Then, only the resistive elements 47A are selectively heated for four-hundred successive lines (i.e. rows) 74A. This cycle of heating the resistive elements 47A for four-hundred lines 74A and heating both the resistive elements 47A and 47B for ten lines 47A and 47B is repeated along the dye transfer area 5 and the edge areas 6 and 7.

A controller 76 shown in FIG. 11, such as a known computer including a line (i.e. row) counter, is connected via suitable cables 78, 78 to the print head 48 and is instructed consistent with known programming techniques to cause the resistive elements 47B to be heated less frequently than the resistive elements 47A as in the aforementioned cycles.

The invention has been described in detail with particular reference to certain preferred embodiments thereof, but it will be understood that variations and modifications can be effected within the spirit and scope of the invention.

Parts List

1. donor web
2. cyan color section
3. magenta color section
4. yellow color section
5. dye transfer area
6. longitudinal edge area
7. longitudinal edge area
W. web width
10. thermal printer
12. dye receiver sheet
14. pick rollers
16. platen
18. tray
19. channel
20. longitudinal guide
22. longitudinal guide
24. trailing edge sensor
26. trailing edge
27. urge rollers
28. capstan roller
30. pinch roller
32. leading edge sensor
34. leading or front edge
36. intermediate tray
38. exit door
40. rewind chamber
42. platen roller
44. cam
46. platen lift
47A, 47B. resistive elements
48. print head
50. donor supply spool
51. first stationary (fixed) web guide
52. second stationary (fixed) web guide or guide nose
54. donor take-up spool
55. cartridge
56. diverter
58. exit tray
60. exit roller
61. exit roller
62. wave-like or ripple distortion
64. creases
66. trailing or rear end portion
68. leading or front end portion
70. line artifacts
72. leading or front end portion
74A, 74B. line-line-by-line contact
76. controller
78. cables

What is claimed is:

1. A method of equalizing web-stretching caused by web tensioning in a dye transfer printer that is for use with a donor web having a dye transfer area and opposite edge areas alongside the dye transfer area, said method comprising:

heating a dye transfer area to effect a dye transfer from the dye transfer area to a dye receiver; and heating the edge areas alongside the dye transfer area less than the dye transfer area is heated to effect the dye transfer, but beating the edge areas sufficiently so that they may be stretched by tension substantially the same as the dye transfer area may be stretched, whereby the dye transfer area will not be stretched thinner than the edge areas, wherein the edge areas alongside the dye transfer area are heated less frequently than the dye transfer area is heated to effect the dye transfer.

2. A method as recited in claim 1, wherein the edge areas alongside the dye transfer area are heated simultaneously with the dye transfer area when the edge areas are to be heated.

3. A method as recited in claim 1, wherein the dye transfer area is heated linewise across the dye transfer area to effect the dye transfer line-by-line along the dye transfer area, and the edge areas alongside the dye transfer area are heated linewise simultaneously with the dye transfer area less frequently than the dye transfer area is heated.

4. A method of equalizing web-stretching caused by web tensioning in a dye transfer printer that is for use with a donor web having a dye transfer area and opposite edge areas alongside the dye transfer area, said method comprising:

heating a dye transfer area to effect a dye transfer from the dye transfer area to a dye receiver; and heating the edge areas alongside the dye transfer area less frequently than the dye transfer area is heated to effect the dye transfer, but heating the edge areas sufficiently so that they may be stretched by tension substantially the same as the dye transfer area may be stretched, whereby the dye transfer area will not be stretched thinner than the edge areas, wherein the dye transfer area is heated linewise across the dye transfer area to effect the dye transfer line-by-line along the dye transfer area, and the edge areas alongside the dye transfer area are heated linewise less frequently than is the dye transfer area.

5. A method as recited in claim 4, wherein the edge areas alongside the dye transfer area are heated linewise simultaneously with the dye transfer area when the edge areas are to be heated.

6. A dye transfer printer in which a donor web having a dye transfer area and opposite edge areas alongside the dye transfer area may be stretched by tension, said printer comprising:

means for heating a dye transfer area to effect a dye transfer from the dye transfer area to a dye receiver; and means for heating the edge areas alongside the dye transfer area less than the dye transfer area is heated to effect the dye transfer, but heating the edge areas sufficiently so that they may be stretched by tension substantially the same as the dye transfer area may be stretched, whereby the dye transfer area will not be stretched thinner than the edge areas, the means for heating the dye transfer area and the means for heating the edge areas alongside the dye transfer area including a bead of selectively heated resistive elements that make contact line-by-line across the dye transfer area and the edge areas, and a controller that causes those resistive elements that make line contact with the edge areas to be heated less frequently than those resistive elements that make line contact with the dye transfer area.

7. A dye transfer printer for use with a donor web having successive dye transfer areas and opposite longitudinal edge areas alongside each one of the dye transfer areas, includes a print head for effecting a dye transfer from a dye transfer area to a dye receiver via a bead of selectively heated resistive elements of said print head that make contact line-by-line across the dye transfer area and the edge areas alongside the dye transfer area when the donor web is advanced under tension over said bead of resistive elements, and is characterized in that:

said resistive elements that make line contact with a dye transfer area are selectively heated line-by-line to effect the dye transfer, and said resistive elements that make line contact with the edge areas alongside said dye transfer area are heated less frequently than line-by-line, but are heated with sufficient frequency so that the edge areas may be stretched by tension substantially the same as the dye transfer area may be stretched, whereby the dye transfer area will not be stretched thinner than the edge areas.

8. A dye transfer printer as recited in claim 7, wherein said resistive elements that make line contact with the edge areas alongside a dye transfer area are heated for at least successive lines when said resistive elements that make line contact with the dye transfer area have been selectively heated for at least two-hundred successive lines.

9. A method of equalizing web-stretching in a dye transfer printer that is for use with a donor web having successive dye transfer areas and opposite longitudinal edge areas alongside each one of the dye transfer areas, and that includes a print head for effecting a dye transfer from a dye transfer area to a dye receiver via a bead of selectively heated resistive elements of the print head that make contact line-by-line across the dye transfer area and the edge areas alongside the dye transfer area when the donor web is advanced under tension over the bead of resistive elements, said method comprising:

selectively heating said resistive elements that make line contact with a dye transfer area line-by-line to effect the dye transfer; and heating said resistive elements that make line contact with the edge areas alongside a dye transfer area less frequently than line-by-line, but heating them with sufficient frequency so that the edge areas may be stretched by tension substantially the same as the dye transfer area may be stretched, whereby the dye transfer area will not be stretched thinner than the edge areas.

* * * * *

UNITED STATES PATENT AND TRADEMARK OFFICE

CERTIFICATE OF CORRECTION

PATENT NO. : 6,781,616 B2
DATED : August 24, 2004
INVENTOR(S) : Terrence L. Fisher, Sr.

It is certified that error appears in the above-identified patent and that said Letters Patent is hereby corrected as shown below:

Column 8,
Line 46, change "beating" to -- heating --

Signed and Sealed this

First Day of February, 2005

JON W. DUDAS
*Director of the United States Patent and Trademark Office*